US006257584B1

(12) United States Patent
Nasuti

(10) Patent No.: US 6,257,584 B1
(45) **Date of Patent: *Jul. 10, 2001**

(54) SHOOTING TARGET APPARATUS

(76) Inventor: Randy Nasuti, 18989 Holbrook, Eastpointe, MI (US) 48021

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/299,198

(22) Filed: Apr. 23, 1999

(51) Int. Cl.[7] ..... F41J 1/10; F41J 7/00
(52) U.S. Cl. ..... 273/407; 273/406; 273/403
(58) Field of Search ..... 273/403, 404, 273/407, 408, 406

(56) References Cited

U.S. PATENT DOCUMENTS

| | | | | |
|---|---|---|---|---|
| 398,186 | * | 2/1889 | Rehfuss | 273/406 |
| 863,486 | * | 8/1907 | Aiken | 273/406 |
| 1,928,768 | * | 10/1933 | Sell et al. | 273/406 |
| 2,048,155 | | 7/1936 | Armantrout . | |
| 3,601,353 | * | 8/1971 | Dale | 273/407 |
| 4,247,116 | | 1/1981 | McQuary . | |
| 4,491,328 | | 1/1985 | Meyer . | |
| 4,548,414 | * | 10/1985 | Denis | 273/407 |
| 4,629,188 | | 12/1986 | Mahieu . | |
| 4,811,956 | | 3/1989 | Foreman . | |
| 5,169,157 | | 12/1992 | Salmon . | |
| 5,209,492 | * | 5/1993 | Hamilton | 273/407 |
| 5,829,753 | * | 11/1998 | Wiser | 273/407 |

FOREIGN PATENT DOCUMENTS

| | | | | |
|---|---|---|---|---|
| 3627295 | * | 10/1991 | (DE) | 273/407 |
| 403241296 | * | 10/1991 | (JP) | 273/408 |

* cited by examiner

*Primary Examiner*—Mark S. Graham
(74) *Attorney, Agent, or Firm*—Kevin G. Mierzwa

(57) ABSTRACT

A target apparatus comprises a supply rod having a first portion and a second portion. A receiver rod has a third portion and a fourth portion. A tubular target dispenser has a hollow portion and has a number of targets and receives the supply rod. The target is coupled over the dispenser and extends to the receiver rod. The first, second, third and fourth portions are sized to be received within the hollow portion.

21 Claims, 2 Drawing Sheets

SHOOTING TARGET APPARATUS

TECHNICAL FIELD

The present invention relates generally to targets. More specifically, the present invention relates to a portable target for assisting a gun user in determining the direction of a shot.

BACKGROUND OF THE INVENTION

For fire arm users, it is important to properly adjust the sight to coincide with the direction of a shot. Various types of ammunition by various manufacturers may have different firing characteristics. A hunter commonly tests his firm arm to insure alignment with the sight.

Testing alignment is particularly important when using a shotgun. The pattern that the shot from a shotgun makes is very important. The shot pattern can vary widely between various types and brands. It is, therefore, necessary to properly calibrate a shotgun for accurate shooting.

When hunting, patterning of a shotgun is commonly carried out in the woods. A piece of newspaper is propped up against a tree stump while the hunter takes a practice shot. Several drawbacks to such an approach should be evident to hunters. First, it is often difficult to secure a piece of paper with implements found in the woods. The large size paper needed and the means to hold it is often cumbersome and hard to come by. Second, it is common that the target is located at or very near the ground. This does not provide an accurate angle for patterning.

Known targets such as those described in U.S. Pat. Nos. 2,048,155 and 4,811,956 each offer a target holding solution. Each of the target mechanisms are very complex and are believed to be expensive to manufacture. Also, the weight associated with the complex mechanisms is believed to make these target holders not suitable for traveling in a pack for a day in the woods.

SUMMARY OF THE INVENTION

It is, therefore, one object of the invention to provide an easily transportable target apparatus It is a further object of the invention to provide a lightweight and collapsible target apparatus.

In one aspect of the invention, a target apparatus comprises a supply rod having a first portion and a second portion. A receiver rod has a third portion and a fourth portion. A tubular target dispenser has a number of targets and receives the supply rod. The target is coupled over the dispenser and extends to the receiver rod.

In a further aspect of the invention, the first and second portion of the supply rod and the first and second portion of the receiver rod each have a length shorter than the supply rod. In transport, the first and second portions of the supply rod and the first and second portions of the receiver rod fit within the tubular target dispenser.

One advantage of the invention is that the target apparatus may be formed from lightweight materials such as fiberglass or thin steel rods. Another object of the invention is that due to its compact size and self-storing capability, the target apparatus may be easily transported for a day in the woods or at target range.

Other objects and features of the present invention will become apparent when viewed in light of the detailed description of the preferred embodiment when taken in conjunction with the attached drawings and appended claims.

BRIEF DESCRIPTION OF THE PREFERRED EMBODIMENT

Figure 1:
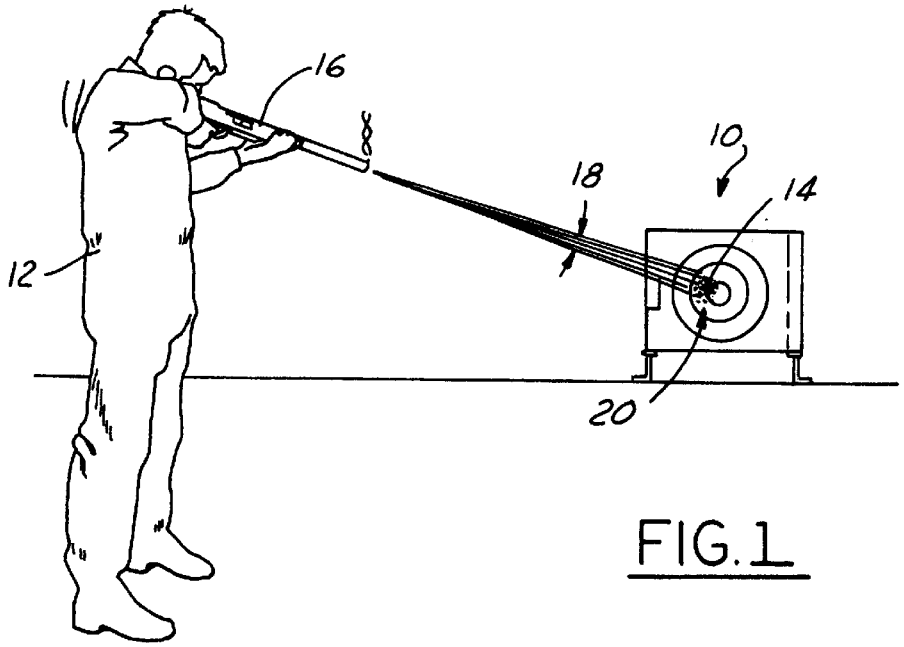
FIG. 1 is a perspective view of a shooting target apparatus with respect to a gun user.

Referring now to the drawings, like reference numerals are used to identify identical components in the various views. While a preferred embodiment is illustrated with respect to a shotgun, the teachings may apply equally to other firearms such as handguns and rifles, and may also be used with archery or other shooting devices.

Referring now to FIG. 1, a target apparatus 10 is shown with respect to a hunter 12 who is firing shot 14 from a shotgun 16. As is shown, shot 14 has a diverging angle 18. By using target apparatus 10, a pattern 20 formed by shot 14 may be measured. Target apparatus 10 may be positioned at various distances from hunter 12. Also, the type of shot and choke of shotgun 16 may also be varied so that a variety of conditions may be simulated.

Referring now to FIGS. 2, 3, 4, and 5, a target apparatus 10 is shown having a supply rod 22 and a receiving rod 24. Supply rod 22 has a first portion 26 which is connected to a second portion 28. Receiving rod 24 has a first portion 30 and a second portion 32. First portion 30 is connected to second portion 32. In the preferred embodiment, first portions 26, 30 are respectively coupled to second portions 28, 32 by ferrules 34, 36.

Supply rod 22 is received within a target dispenser 38. Target dispenser 38 has a target 40 or a plurality of targets rolled upon its outer surface. Target dispenser 38 has a hollow interior 42 that receives supply rod 22. Target dispenser 38 may be formed of cardboard. As will be further described, the hollow interior may be sized to store the components of target apparatus 10. Receiving rod 24 is positioned a distance from supply rod 22 and receives an unrolled. target 40.

First portion 26 has a length $L_1$ and second portion 28 has a second length $L_2$. First portion 30 has a length $L_3$ and second portion 32 has a fourth length $L_4$. Target dispenser 38 has a length $L_5$ which is longer than lengths $L_1$, $L_2$, $L_3$, and $L_4$ so that that supply rod portions and receiving rod portions may be received within hollow interior 42 of target dispenser 38.

Figure 3:
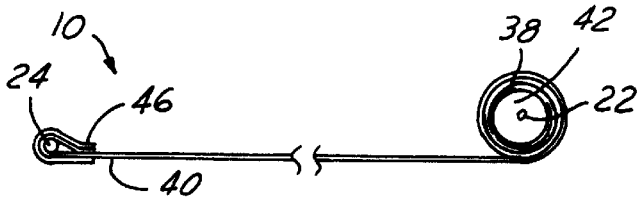
FIG. 3 is a top view of the apparatus of FIG. 2 according to the present invention.

Target 40 is preferably formed of paper. If a number of targets are contained in a single roll, perforations 44 may be provided through the targets so that the individual targets may be easily separated. As is best shown in FIG. 3, target 40 is wrapped around receiving rod 24. Preferably, target has a removable adhesive such as the adhesive used on Post-it® brand notes manufactured by 3M Company. Such an adhesive allows the target 40 to be attached to or around receiving rod 24 and easily removed and reattached. The adhesive is preferably only applied to the edge portion of target 40 so that a sufficient amount of holding force may be applied when target 40 is wrapped around and attached to itself around receiving rod 24. Adhesive portion 46 is also used to secure targets 40 to target dispenser 38 during transportation. Target 40 has aiming indicia 48 printed on the surface. Aiming indicia 48 may include a ringed target or the outline of an animal figure.

Figure 2:
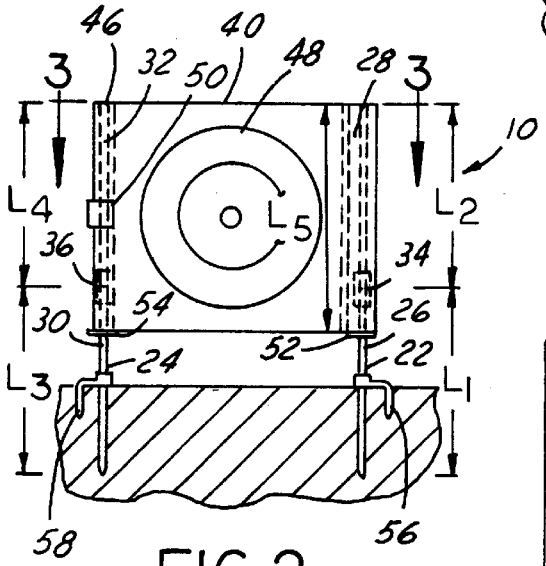
FIG. 2 is a front view of a target apparatus according to the present invention.
Figure 4:
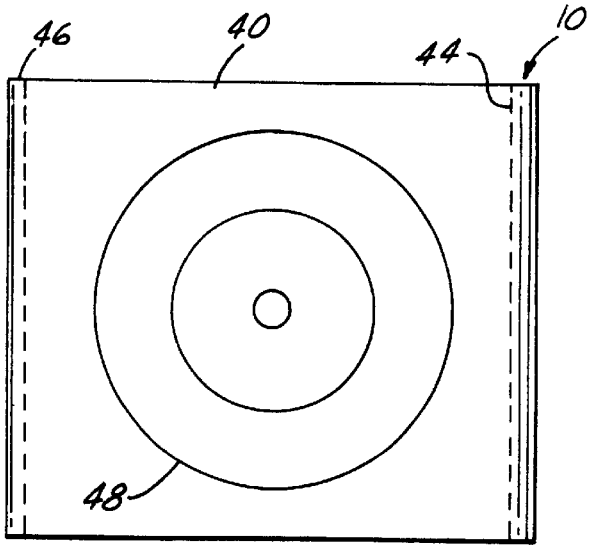
FIG. 4 is a front view of a target apparatus having various shooting indicia thereupon.
Figure 5:
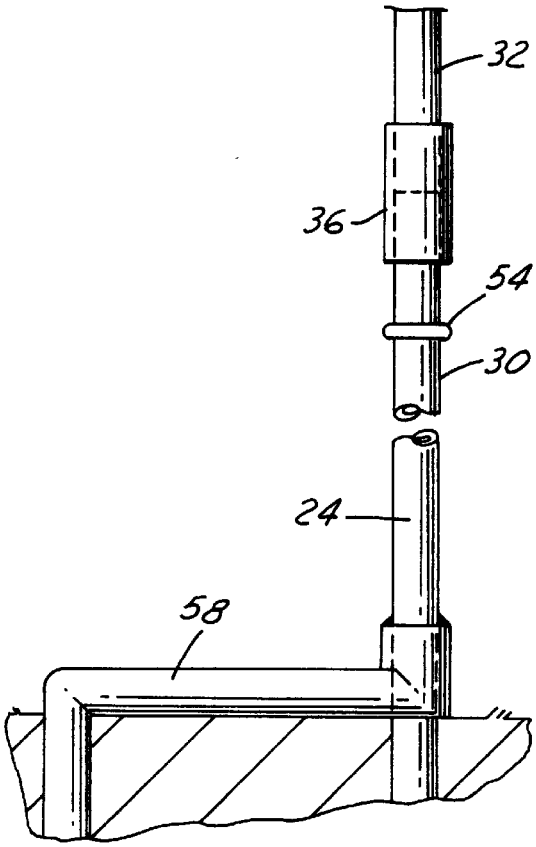
FIG. 5 is a front view of a upper side leg and a lower side leg coupled together.

As is best shown in FIGS. 2 and 3, target: 40 may have, in addition to or in place of adhesive portion 46, a clamp 50 or a plurality of clamps that hold target 46 to receiving rod 24. Clamps 50 may be formed of a spring-loaded clip.

A stop 52 may be fastened to supply rod 22 in order to support target dispenser 38. A second stop 54 coupled to receiving rod 24 may also be used to support target 40. First portion 26 has a length $L_1$. Stops 52, 54 may be formed of a washer-like apparatus coupled to supply rod 22 or receiving rod 24. Stops 52, 54 may also be formed of a crimp of material on rods 22, 24.

A spike 56 may be coupled to supply rod 22 to prevent supply rod 22 from rotating. Spike 56 may be also used to stabilize supply rod 22. Spike 56 is preferably shaped so that it may be easily inserted into the ground. A second spike 58 may also be coupled to receiving rod 24 to stabilize and secure receiving rod 24. Spikes 56, 58 are particularly useful in preventing the rotation of supply rod 22 and receiving rod 24 when target 40 is fired upon.

Figure 7:
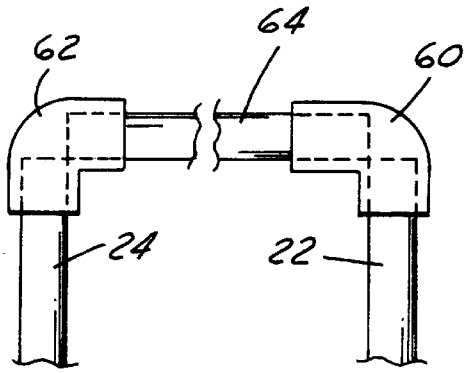
FIG. 7 is a front view of an alternative embodiment of the present invention having a cross member coupled between the two legs.

Referring now to FIG. 7, an alternative embodiment of target apparatus 10 is shown. As shown above, supply rod 22 and receiving rod 24 are separate pieces not joined together. In this embodiment, supply rod 22' and receiving rod 24' have respective corner ferrules 60, 62 coupled thereto. A cross member 64 is coupled between corner ferrules 60 and 62. Cross member 64 is also preferably sized to fit within hollow interior 42 of target dispenser 38 or will have ferrule to join rod 64 so it may fit in dispenser 38.

Figure 6:
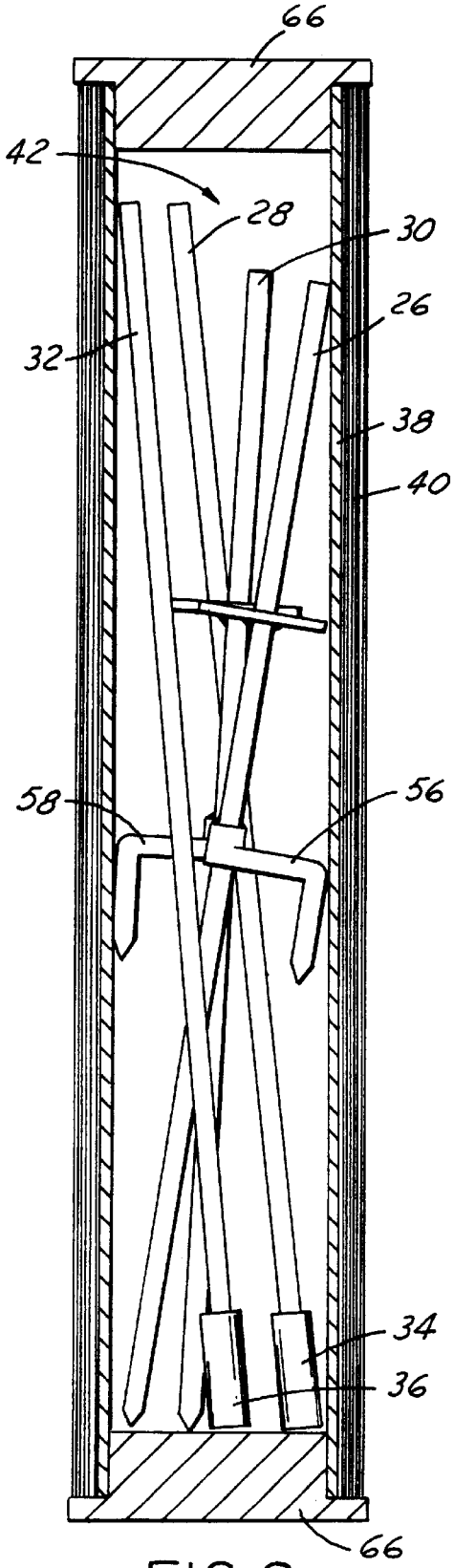
FIG. 6 is a cross-sectional view of a target apparatus in a storage implementation.

Referring now to FIG. 6, to transport; target apparatus 10, a pair of end caps 66 may be provided that are used to enclose each end of target dispenser 38. As illustrated, target dispenser 38 is relatively compact in design and therefore easily carried in a pack.

In operation, target apparatus 10 is easily assembled by inserting first portion 26 and second portion 28 into ferrule 34. Receiving rod 24 is assembled by placing first portion 30 and second portion 32 into ferrule 36. Supply rod 22 and receiving rod 24 are secured to the ground by inserting spikes 56, 58 into the ground. Target dispenser 38 is placed over supply rod 22, and a target 40 is extended to receiving rod 24. Target 40 is wrapped around receiving rod 24 and secured. The securing means may include clamp 50 or adhesive portion 46 as described above. Shots may then be fired at target 40 so that the shot pattern may be characterized.

If another shot is desired to be measured, target 40 may be separated at perforations 44, and a second target 40 may be extended to receiving rod 24.

Target apparatus may then be disassembled into its various components and placed within hollow interior 42 of target dispenser 38 for easy transportation.

While particular embodiments of the invention have been shown and described, numerous variations and. alternate embodiments will occur to those skilled in the art. Accordingly, it is intended that the invention be limited only in terms of the appended claims.

What is claimed is:

1. A target apparatus comprising:

a supply rod having a first portion having a first length and a second portion, said first portion separable from said second portion;

a receiving rod having a third portion and a fourth portion, said third portion separable from said fourth portion;

a target;

a tubular target dispenser having a second length greater than the first length, said dispenser substantially receiving said first portion and partially receiving said second portion therein, said target coupled over said dispenser and sized to extend to said receiving rod.

2. A target apparatus as recited in claim 1 further comprising a first ferrule coupled to said receiving rod and a second ferrule coupled to said supply rod.

3. A target apparatus as recited in claim 1 further comprising a stop coupled to said receiving rod.

4. A target apparatus as recited in claim 3 wherein said stop comprises a crimp.

5. A target apparatus as recited in claim 1 further comprising an end cap to be received within said dispenser.

6. A target apparatus as recited in claim 1 wherein said target has aiming indicia.

7. A target apparatus as recited in claim 1 further comprising a first spike coupled to said supply rod.

8. A target apparatus as recited in claim 1 further comprising a second spike coupled to said receiving rod.

9. A target apparatus as recited in claim 1 wherein said target dispenser has a hollow interior sized to receive said supply rod and said receiving rod.

10. A target apparatus as recited in claim 1 further comprising a first corner ferrule sized to receive said supply rod, a second corner ferrule to receive said receiving rod and a cross member, said first corner ferrule and said second corner ferrule receiving said cross member.

11. A target apparatus comprising:

a supply rod having a first portion and a second portion having a first length and a second length, respectively portion, said first portion separable from said second portion;

a receiving rod having a third portion and a fourth portion, having a third length and a fourth length, respectively, said third portion separable from said fourth portion;

a target; and a tubular target dispenser substantially receiving said first portion and partially receiving said second portion therein, said target coupled over said dispenser and sized to extend to said receiving rod, said dispenser having a fifth length greater than said first length, said second length, said third length and said fourth length.

12. A target apparatus as recited in claim 11 further comprising a first ferrule coupled to said receiving rod and a second ferrule coupled to said supply rod.

13. A target apparatus as recited in claim 11 further comprising a stop coupled to said supply rod.

14. A target apparatus as recited in claim 13 wherein said stop comprises a crimp.

15. A target apparatus as recited in claim 11 further comprising an end cap to be received within said tubular target dispenser.

16. A target apparatus as recited in claim 11 wherein said target has aiming indicia.

17. A target apparatus as recited in claim 11 further comprising a first spike coupled to said supply rod.

18. A target apparatus as recited in claim 11 further comprising a second spike coupled to said receiving rod.

19. A target apparatus as recited in claim 11 wherein said target is perforated.

20. A target apparatus as recited in claim 11 wherein said target comprises an adhesive region along an edge thereof.

21. A target apparatus having an assembled state and a disassembled state comprising:

in the assembled state:

a supply rod having a first portion and a second portion having a first length and a second length, respectively;

a first ferrule coupling said first portion and said second portion;

a receiving rod having a third portion and a fourth portion, a third length and a fourth length, respectively;

a second ferrule coupling said third portion and said fourth portion;

a target;

a tubular target dispenser receiving said supply rod, said target coupled over said dispenser and sized to extend to said receiving rod, said dispenser having a fifth length greater than said first length, said second length, said third length and said fourth length, a pair of end caps sized to be secured to said tubes, wherein in the disassembled state, said first portion said second portion, said third portion and said fourth portion received within said hollow interior of said dispenser and said pair of end caps received in a respective end of said dispenser.

* * * * *